US008061808B2

(12) United States Patent
Nagata

(10) Patent No.: US 8,061,808 B2
(45) Date of Patent: Nov. 22, 2011

(54) RECORDING HEAD

(75) Inventor: Shingo Nagata, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 465 days.

(21) Appl. No.: 12/248,787

(22) Filed: Oct. 9, 2008

(65) Prior Publication Data

US 2009/0096835 A1 Apr. 16, 2009

(30) Foreign Application Priority Data

Oct. 10, 2007 (JP) ..... 2007-264536
Aug. 4, 2008 (JP) ..... 2008-200945

(51) Int. Cl.
*B41J 2/14* (2006.01)

(52) U.S. Cl. ..... 347/47

(58) Field of Classification Search ..... 347/47, 347/9, 29, 33, 85–86
See application file for complete search history.

(56) References Cited

U.S. PATENT DOCUMENTS

| | | | | |
|---|---|---|---|---|
| 5,850,238 | A * | 12/1998 | Karita et al. | 347/29 |
| 6,132,028 | A * | 10/2000 | Su et al. | 347/47 |
| 6,267,904 | B1 * | 7/2001 | Silverbrook | 216/27 |
| 6,578,956 | B1 | 6/2003 | Hosaka | |
| 7,207,648 | B2 * | 4/2007 | Kojima et al. | 347/22 |
| 2001/0024219 | A1 | 9/2001 | Kanda | |
| 2006/0115598 | A1 | 6/2006 | Kaneko | |

FOREIGN PATENT DOCUMENTS

| | | |
|---|---|---|
| JP | 03-176156 | 7/1991 |
| JP | 04-169238 | 6/1992 |
| JP | 2000-313117 | 11/2000 |
| JP | 2001-260361 | 9/2001 |
| JP | 2006-175657 | 7/2006 |
| JP | 2006-212796 | 8/2006 |

* cited by examiner

*Primary Examiner* — Geoffrey Mruk
(74) *Attorney, Agent, or Firm* — Canon USA Inc IP Division

(57) ABSTRACT

An inkjet recording head includes a substrate having a discharge port surface on which discharge ports configured to discharge a liquid are formed. The discharge port surface of the substrate includes a plurality of point-symmetrical continuous grooves which are centered around each discharge port. The plurality of point-symmetrical continuous grooves differs in shape between in a region near each discharge port and in another region.

4 Claims, 15 Drawing Sheets

ENLARGED

ENLARGED

RECORDING HEAD

BACKGROUND OF THE INVENTION

1. Field of the Invention

The present invention relates to an inkjet recording head which is provided during distribution with a protective tape on a discharge port forming surface, which is a surface on which discharge ports are formed. More specifically, the present invention relates to an inkjet recording head which can be suitably protected by a protective tape and from which the protective tape can be suitably peeled off as a result of suitably configuring the structure of the discharge port forming surface on which the protective tape is provided.

2. Description of the Related Art

Generally, inkjet recording heads which are mounted on an inkjet recording apparatus are provided with a protective member on the discharge port forming surface to ensure safe distribution. As one configuration example, a configuration such as that illustrated in FIG. 12, which is discussed in Japanese Patent Application Laid-Open No. 03-176156 (U.S. Pat. No. 5,850,238), is known. In this example, a configuration is employed which ensures the reliability of the sealing properties by covering a discharge port forming surface H2 of an inkjet recording head H1 with a protective tape C2, and further covering the protective tape C2 with a cap member C1. As a result of this configuration, evaporation of moisture from the discharge ports is suppressed, so that clogging of the discharge ports due to increased viscosity of the ink can be prevented, or adhesion of surrounding dust and the like to the discharge port periphery and to the discharge ports can be prevented.

A configuration is employed in which an adhesive layer is provided on the protective tape for protecting the discharge ports, and the protective tape is adhered to the discharge port forming surface. In a protective tape having such an adhesive layer, if a suitable adhesive layer is not formed, the adhesive material forming the adhesive layer may intrude into the discharge ports, or remain on the discharge port forming surface when the protective tape is peeled off, thereby affecting discharge. To resolve this problem, for example, the configuration illustrated in FIGS. 13A and 13B, which is discussed in Japanese Patent Application Laid-Open No. 2000-313117 (U.S. Pat. No. 6,578,956), has been proposed. This configuration is directed to making it easier for the protective tape to be peeled off and harder for the adhesive material to remain on the discharge port forming surface, by employing a configuration in which the adhesion surface area per unit area of the protective tape C2 in the periphery H20 of the discharge port forming surface H2 is decreased.

In inkjet recording, to achieve high-quality color recording equal to silver halide photography, a head configuration has been employed in which the size of the ink droplets discharged from the inkjet recording head is decreased to small dots so that the dots cannot be easily seen (a grainy effect is not noticeable) on the recorded object. For example, as the small dot ink droplets, the size of the dots has had to be around 5 pL (picoliters, 10-12 liters), with a dot size of 40 to 50 μm and a resolution of 600×1200 to 1200×1200 dpi (dpi is a unit representing the number of dots per inch).

However, to respond to the needs of users who wish to further mitigate grainy effects in the halftone and highlight portions in recent color photo images, it has become required to discharge even smaller dot ink droplets at an even higher density.

For an inkjet recording head which discharges ink by utilizing heat, an often-used configuration has a nozzle member in which a predetermined number of electrothermal transducers are formed on an upper layer of a substrate, and ink channels corresponding to the electrothermal transducers and discharge ports in communication with the respective ink channels are formed on the substrate. Since it is easy to change the dimensions of the discharge ports and ink channels, which affect the discharge amount of ink droplets, such a head configuration is suitable for an inkjet recording head for high-definition recording which discharges minute ink droplets.

As illustrated in FIG. 14, especially the peripheral portion of the discharge ports 6 of the recording head having such a nozzle member is a hollow structure, because it has an ink channel 7 and an electrothermal transducer 2 in its interior. As a result, the discharge port forming surface tends to be fragile against an external force. When discharging smaller dot ink droplets at a higher density, the pitch between each of the ink channels inevitably becomes narrower, so that the proportion of the nozzle member taken up by the ink channels, in other words, the proportion of the hollow structure, increases. Therefore, the strength of the discharge port forming surface against an external force decreases even further. If a conventional discharge port protective tape is employed on an inkjet recording head having such a structure, the adhesive force of the adhesive layer is too high, so that when the protective tape is peeled off cracks may be caused on the discharge port peripheral portions due to that peeling force. In extreme cases, the member forming discharge ports (nozzle member) may even be peeled off from the substrate.

To prevent such a phenomenon, for example, it has been proposed to reduce the peeling force of the tape by changing the type of adhesive material of the protective tape, and for example as discussed in Japanese Patent Application Laid-Open No. 2006-212796, by adjusting the adhesion region on the protective tape side. According to these measures, the above-described problems of cracking and peeling on the discharge port peripheral portions can be avoided. However, because the adhesive strength between the discharge port forming surface and the protective tape is decreased, the phenomenon of ink seeping from the discharge ports can arise. Especially for a recording head having discharge ports which discharge a plurality of colors in a single head, for example, cyan, magenta, and yellow, ink seepage can cause a phenomenon in which ink that has seeped from a discharge port mixes with other colors, and this mixed color ink is sucked back into the original discharge port to cause color mixing as far as inside the ink channel.

Further, for an inkjet recording head having a configuration which can discharge ink droplets in a plurality of sizes, for example, about 5 pL and 2 pL, discharge ports and ink channels having different dimensions according to the discharge amount of the ink droplets are intermingled. At each differently-shaped discharge port peripheral portion, the strength against an external force is different. To prevent color mixing due to cracks caused on the discharge port peripheral portions and ink seepage from a discharge port, the proposals which have been made up until now for properly setting the peeling force of the protective tape are not sufficient. For example, even if the protective tape adhesive material and the type of protective tape itself are changed, the selection of that material is difficult. Further, even if the adhesion region on the protective tape side is adjusted, adjusting the positional relationship between the adhesion region and the discharge ports is very complex.

Regarding adjusting the adhesion properties between the protective tape and the discharge port forming surface, as illustrated in Japanese Patent Application Laid-Open No.

2000-313117 (U.S. Pat. No. 6,578,956), a configuration which decreases the adhesive force by reducing the adhesion surface area of the regions away from the discharge ports of the inkjet recording head may also be considered. For example, several techniques for adjusting the structure of the surface of the discharge port forming surface have been proposed. One example is Japanese Patent Application Laid-Open No. 2006-175657 (U.S. Patent Application Publication No. US 2006/0115598) illustrated in FIGS. 15A and 15B. However, in this proposal, the concept is only from the perspective of improving the discharge state of the ink. There is no discussion of a concept from the perspective of adjusting the adhesion properties between the protective tape and the discharge port forming surface during distribution.

SUMMARY OF THE INVENTION

The present invention is directed to an inkjet recording head in which a discharge port forming surface is suitably protected and sealed by a protective tape, and in which cracks and peeling do not occur even when the protective tape is peeled off. Especially, the present invention enables the adhesive strength and adhesion state between the discharge port forming surface and the protective tape to be easily and properly adjusted according to an inkjet recording head which includes discharge ports having a different discharge amount (discharge ports having different aperture diameters).

According to an aspect of the present invention, an inkjet recording head includes a substrate having a discharge port surface on which discharge ports configured to discharge a liquid are formed, wherein the discharge port surface of the substrate includes a plurality of point-symmetrical continuous grooves which are centered around each discharge port, and wherein the plurality of point-symmetrical continuous grooves differ in shape between in a region near each discharge port and in another region.

According to an exemplary embodiment of the present invention, since the adhesion state between a discharge port forming surface of an inkjet recording head and a protective tape can be suitably adjusted according to the configuration of the head, crack formation on a discharge port peripheral portion due to peeling of the protective tape and color mixing due to ink seepage from a discharge port do not occur. An inkjet recording head and a production method thereof can be provided which allows the discharge ports to be protected and sealed by a protective tape in a suitable state for distribution.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

First Exemplary Embodiment

Hereinafter, an inkjet recording head and a production method thereof according to an embodiment of the present invention will be described using FIGS. 1A to 1E and FIGS. 2A to 2H.

In the first embodiment, a plurality of fine, continuous grooves are provided circularly and point-symmetrically centered around each discharge port having a small-diameter and a small array pitch which discharges 2 pL ink droplets. Further, an inkjet recording head has a plurality of grooves whose pitch in the region near the periphery of the discharge port is different from that in other regions. Here, the "pitch" of the grooves represents the inter-groove distance between the centers of adjacent grooves. Hereinafter, this is referred to as "inter-groove distance".

Figure 1A:
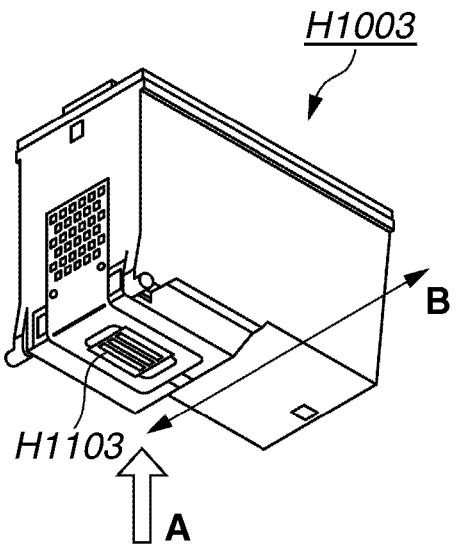
FIGS. 1A to 1E are schematic diagrams illustrating the configuration of an inkjet recording head and a discharge port periphery according to a first embodiment of the present invention.
Figure 1B:
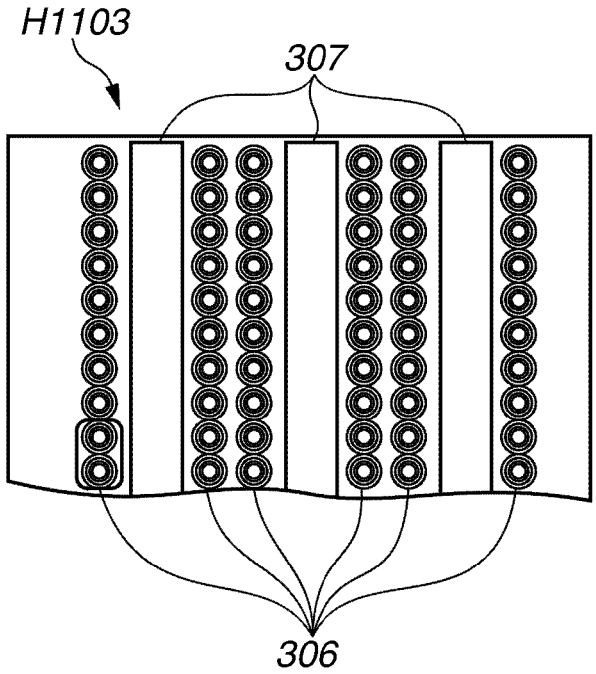

The present embodiment will now be described in more detail. FIG. 1A is an external perspective view illustrating an inkjet recording head H1003 having a recording element substrate H1103 according to an exemplary embodiment of the present invention. FIG. 1B is an enlarged view illustrating a part of the discharge port surface when the recording element substrate H1103 of the inkjet recording head H1003 illustrated in FIG. 1A is viewed from the direction of arrow A.

Figure 1C:
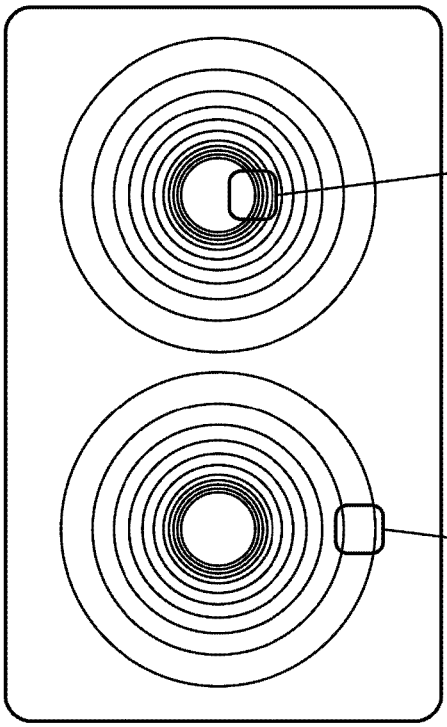
Figure 1D:
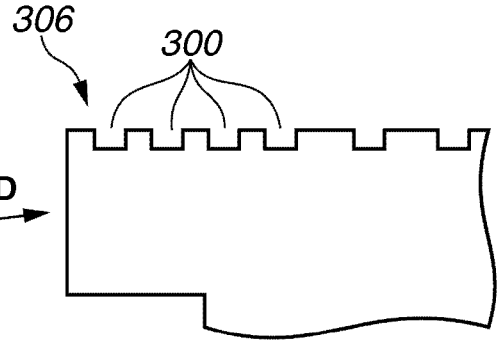
Figure 1E:
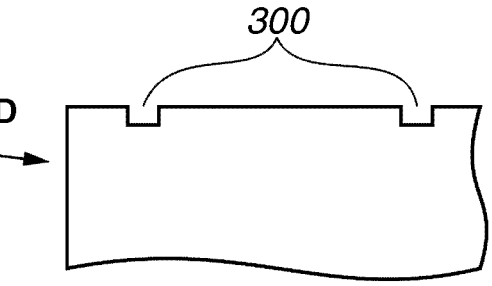

FIG. 1C is an enlarged view illustrating a part of the discharge ports 306 of the recording element substrate H1103. As illustrated in FIG. 1C, grooves 300 are provided on a peripheral region of each discharge port 306. The grooves 300 are configured so that the pitch of the grooves in the region near the periphery of the discharge ports is different from that in other regions. FIG. 1D is an enlarged cross-sectional view illustrating a part of the grooves 300 provided near the discharge port 306. FIG. 1E is an enlarged cross-sectional view illustrating a part of the grooves 300 provided on a region away from the discharge port 306. It is noted that FIGS. 1B and 1C are views as seen from the direction of arrow A in FIG. 1A, and FIGS. 1D and 1E are cross-sectional views in the direction of arrow B in FIG. 1A, which is orthogonal to arrow A.

As illustrated in FIG. 1B, three ink supply ports 307 are formed on the recording element substrate H1103. One of cyan, magenta, or yellow ink is supplied from each of the ink supply ports 307. Discharge ports 306 are arranged in columns in positions which are line-symmetrical and centered around each of the ink supply ports 307. The dimensions of the discharge ports 306 and the ink channels are adjusted so that ink droplets of about 2 pL are discharged from each of the discharge ports 306. As illustrated in FIGS. 1C and 1D, on a peripheral portion of the discharge port 306, grooves 300 having a depth of about 2 μm and a width of about 2 μm are provided in concentric circles centered around the discharge port 306. Although the shape of the grooves 300 is the same, as illustrated in FIGS. 1D and 1E, the inter-groove distance is different moving further away from the discharge port 306. Specifically, as illustrated in FIG. 1D, at the peripheral portion of the discharge port 306 the grooves 300 are formed with an inter-groove distance of about 4 μm. On the other hand, as illustrated in FIG. 1E, moving further away from the discharge port 306, the inter-groove distance gradually increases. Specifically, the inter-groove distance of the grooves 300 provided on the peripheral region side of the discharge port 306 is smaller than the inter-groove distance of the grooves provided on the region side away from the discharge port 306.

A protective tape is stuck on such an inkjet recording head H1003 so as to completely cover the discharge ports 306. The protective tape is coated with an acrylic-based adhesive material on one surface of a tape substrate using 25 μm-thick polyethylene terephthalate. The protective tape is stuck so as to completely cover the discharge ports 306 in order to prevent fixing due to increased viscosity of the ink caused by the evaporation of moisture in the ink, and to prevent ink spillage during distribution.

An inkjet recording head H1003 in this state was subjected to an accelerated test in which the inkjet recording head was stored for two months in an environment maintained at 60° C. Then, the protective tape was peeled off, and printing was performed. When the protective tape was peeled off, no peeling of the nozzle member from the substrate was deemed to have occurred. The discharge port surface was observed using a metal microscope, but cracks etc., had not been formed on the discharge port peripheral portions. Further, the printing performed after peeling off the protective tape was good, and discharge failure etc., caused by fixing due to increased viscosity of the ink was not found to have occurred.

The grooves provided on the discharge port peripheral portions were very effective. Specifically, by providing grooves with a relatively narrow inter-groove distance on the discharge port peripheral portions, the adhesion surface area between the discharge port surface and the protective tape adhesive material decreases. Therefore, since the peeling force when peeling off the protective tape decreases, peeling of the nozzle member from the substrate and the formation of cracks etc., on the discharge port peripheral portions can be avoided. In contrast, at the regions away from the discharge ports 306, by providing grooves with a relatively wide inter-groove distance, the adhesion surface area between the discharge port surface and the protective tape adhesive material increases. Although the peeling force when peeling off the protective tape increases, this region does not have a hollow structure since it is away from the ink channels. Further, since this region is relatively strong against an external force, peeling etc., of the nozzle member from the substrate can be avoided. Moreover, the adhesion surface area between the discharge port surface and the protective tape adhesive at this region is secured, and the adhesive force increases. Even should ink somehow seep out of a discharge port, the problem of the ink mixing with other colors, and this mixed color ink being sucked back into the original discharge port to cause color mixing as far as inside the ink channel, can be prevented.

FIGS. 2A to 2H are schematic cross-sectional views illustrating an example of the basic production steps of a nozzle member of the above-described inkjet recording head.

First, an Si substrate 301 including an electrothermal transducer 302, which is an energy generating element, is prepared.

Figure 2A:
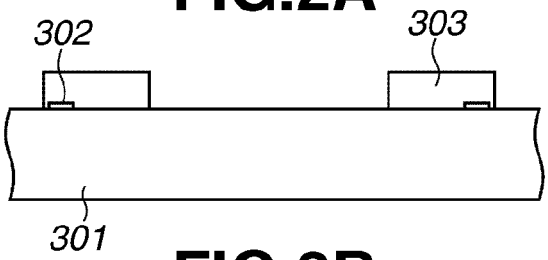
FIGS. 2A to 2H are schematic diagrams illustrating the production steps of a discharge port portion of the inkjet recording head according to the first embodiment.

As illustrated in FIG. 2A, a plurality of electrothermal transducers 302 are provided on the Si substrate 301. Next, a soluble resin mold material 303, which will become a liquid channel (ink channel), is formed on the Si substrate 301 including the electrothermal transducers 302. The mold material 303 occupies a portion which will subsequently become a liquid channel. The mold material (ODUR, manufactured by Tokyo Ohka Kogyo Co., Ltd.) is applied by spin coating, and then the applied coating is exposed and developed to form a pattern.

Figure 2B:
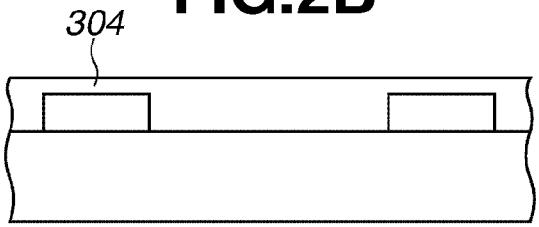

Next, as illustrated in FIG. 2B, a nozzle forming member 304 is applied by spin coating. The nozzle forming member 304 is produced by dissolving an epoxy resin and a photocationic polymerization initiator in a solvent.

Figure 2C:
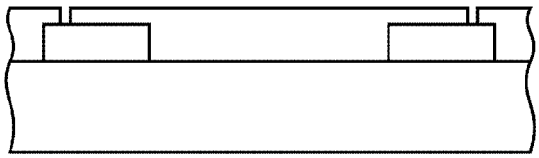

Subsequently, as illustrated in FIG. 2C, using a mirror projection mask aligner (MPA-600 Super, manufactured by Canon Inc.) on the nozzle forming member 304, exposure is performed via a mask. The portions which will ultimately be a discharge port are not exposed at this stage. The regions which were not exposed are removed with a developing solution.

Figure 2D:
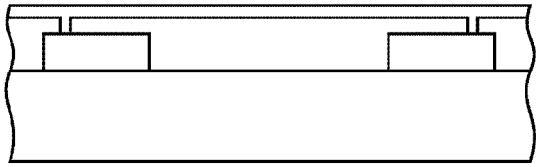

Further, as illustrated in FIG. 2D, a nozzle forming member 304 is again applied.

Figure 2E:
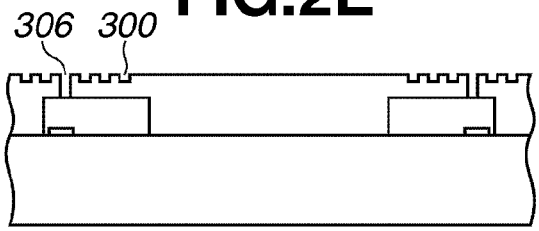

Subsequently, as illustrated in FIG. 2E, using the mirror projection mask aligner (MPA-600 Super, manufactured by Canon Inc.), exposure is performed via a mask. The portions which will ultimately be discharge ports and grooves are not exposed at this stage. Discharge ports 306 and grooves 300 are formed by removing the regions which were not exposed with a developing solution.

Figure 2F:
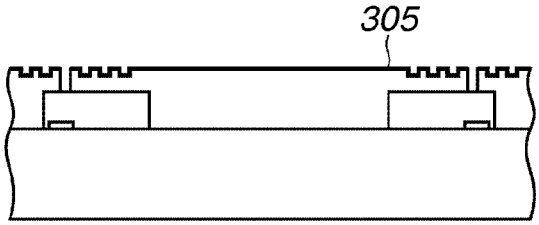

Next, as illustrated in FIG. 2F, a water-repellent member 305 is applied by spin coating on the nozzle forming member 304 on which the discharge ports 306 and the grooves 300 are formed. The mirror projection mask aligner (MPA-600 Super, manufactured by Canon Inc.) is again used. A water-repellent treatment is performed on the whole region of the discharge port surface, including the interior of the grooves 300, by exposing the water-repellent member 305 via a mask, and then removing the regions which were not exposed with a developing solution.

Figure 2G:
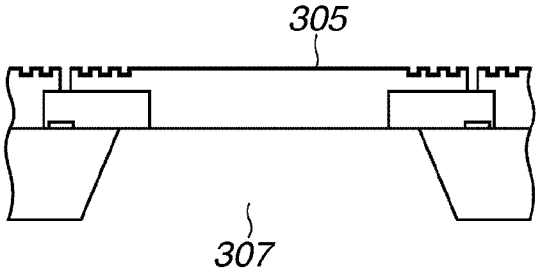

Further, as illustrated in FIG. 2G, a substrate patterned with the mold material 303, the nozzle forming member 304, and the water-repellent member 305 are etched with Si by dipping in an aqueous solution of 22 wt % TMAH having a temperature which is adjusted by heating to about 80° C. to form an ink supply port 307.

Figure 2H:
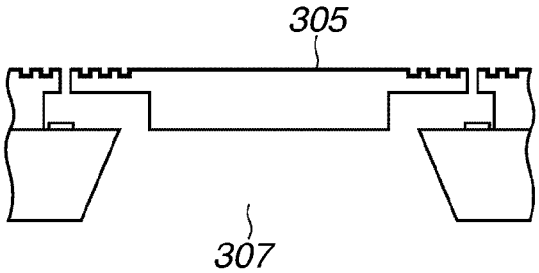

Finally, as illustrated in FIG. 2H, the nozzle member of an inkjet recording head is formed by eluting the mold material 303 from the discharge port 306 and the ink supply port 307. The Si substrate on which the nozzle member is formed is separated by cutting with a dicing saw to form a chip. Using a recording element substrate H1103 which has been formed into a chip, the inkjet recording head H1003 illustrated in FIG. 1A is produced.

Second Exemplary Embodiment

In the present embodiment, like in the first embodiment, discharge ports which discharge 2 pL ink droplets are provided. In the second embodiment, fine, continuous grooves are provided at an angle and point-symmetrically centered around each discharge port. An inkjet recording head was produced having grooves whose width (groove shape) and pitch (inter-groove distance) in the region near the periphery of the discharge ports was different from that in other regions. The effects of this inkjet recording head were confirmed.

The production steps of the nozzle members in the inkjet recording head are similar to that in the first embodiment. However, by changing the pattern applied on the mask used during exposure, the shape of the groove portions can be easily changed from that in the first embodiment. First, the nozzle members of the inkjet recording head are formed, and then the nozzle members are separated by cutting with a dicing saw to form chips. Using a recording element substrate H1104 which has been formed into a chip, an inkjet recording head H1004 illustrated in FIG. 3A is produced according to similar steps as in the first embodiment.

Figure 3A:
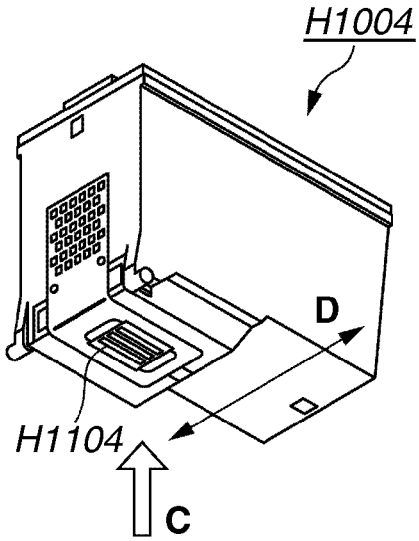
FIGS. 3A to 3E are schematic diagrams illustrating the configuration of an inkjet recording head and a discharge port periphery according to a second embodiment of the present invention.
Figure 3B:
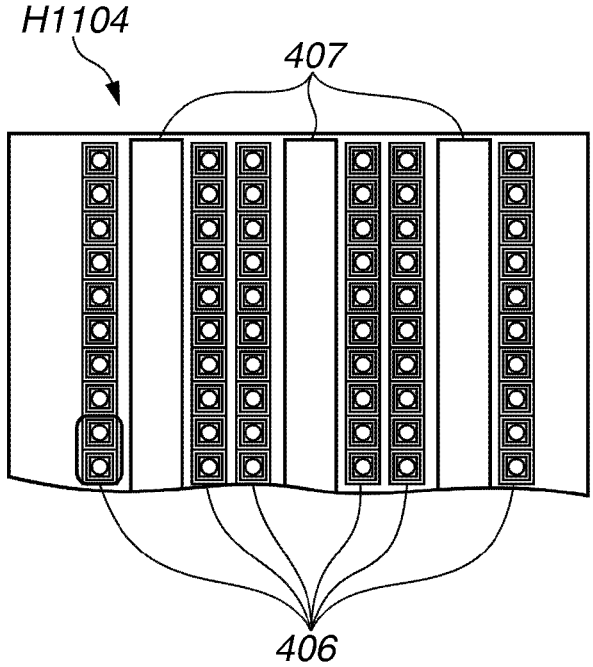
Figure 3C:
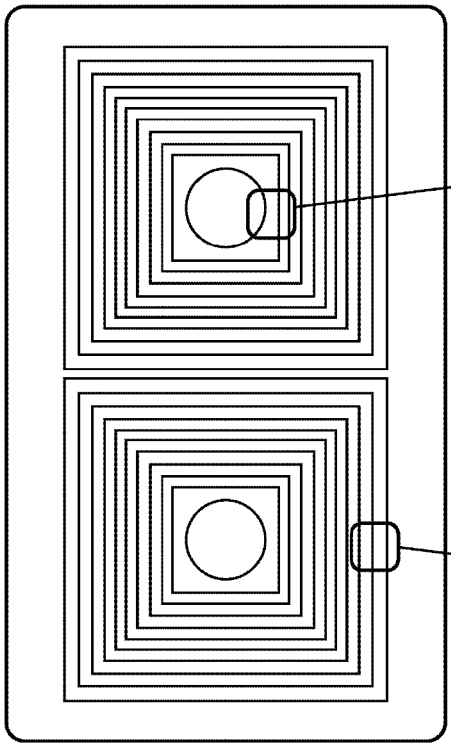
Figure 3D:
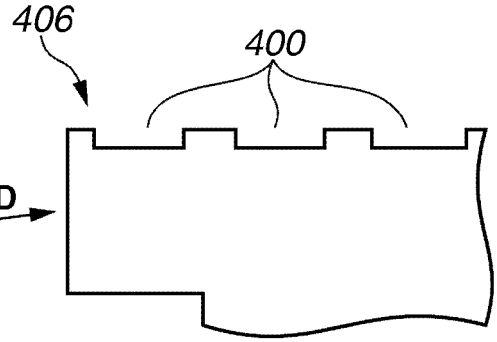
Figure 3E:
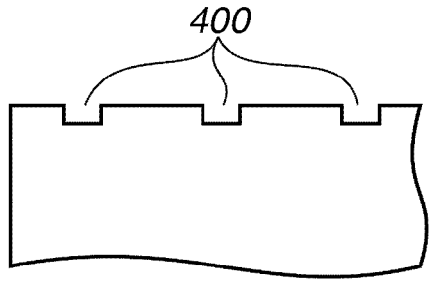

FIG. 3B is an enlarged view of a discharge port surface when the recording head illustrated in FIG. 3A is seen from the direction of arrow C. FIG. 3C is an enlarged view of a discharge port 406 portion. FIG. 3D is an enlarged cross-sectional view of grooves 400 provided on a peripheral region of the discharge port 406. FIG. 3E is an enlarged cross-sectional view of the grooves 400 provided on a region away from the discharge port 406. It is noted that FIGS. 3B and 3C are views as seen from the discharge port surface side, which is the direction of arrow C in FIG. 3A, and FIGS. 3D and 3E are cross-sectional views in the direction of arrow D in FIG. 3A, which is orthogonal to arrow C.

Three ink supply ports 407 are also formed on the recording element substrate H1104 illustrated in the present embodiment. Discharge ports 406 are arranged in opposing positions centered around each of the ink supply ports. The dimensions of the discharge ports and the ink channels are adjusted so that ink droplets of about 2 pL are discharged from each of the discharge ports. As illustrated in FIGS. 3C and 3D, on the peripheral portion of the discharge port 406, grooves 400 having an inter-groove distance of about 9 μm are provided in concentric squares symmetrically centered around the discharge port 406. Although the grooves 400 themselves are formed at the peripheral portion of the discharge ports 406 in a shape having a depth of about 2 μm and a width of about 6 μm, as illustrated in FIG. 3E, the groove width becomes gradually narrower moving further away from the discharge ports 406. Specifically, the groove width of the grooves 400 provided on the region side away from the discharge port 406 is narrower than the groove width of the grooves 400 provided on the periphery region side of the discharge port 406.

A protective tape is stuck on such an inkjet recording head H1004. Using the same protective tape as described in the first embodiment, the tape is stuck so as to completely cover the discharge ports 406. An inkjet recording head H1004 in this state was subjected to an accelerated test in which the inkjet recording head was stored for two months in an environment maintained at 60° C. Then, the protective tape was peeled off, and printing was performed. As in the first embodiment, no peeling of the nozzle member from the substrate or cracks etc., on the discharge port peripheral portions occurred, and the printing was also good. Thus, the grooves provided on the discharge port peripheral portions were very effective. Specifically, by providing grooves with a relatively wide width on the discharge port peripheral portions, the adhesion surface area between the discharge port surface and the protective tape adhesive material decreases, and the peeling force when peeling off the protective tape decreases. As a result, the occurrence of peeling of the nozzle member from the substrate and cracks etc., on the discharge port peripheral portions can be avoided. In contrast, by providing, at the regions away from the discharge ports, grooves which have a narrower width than the grooves provided at the peripheral portions, the respective inter-groove distances can be increased. Therefore, the adhesion surface area between the discharge port surface and the protective tape adhesive material increases, and the peeling force when peeling off the protective tape increases. However, since it is away from the ink channels 407, this region does not have a hollow structure and is relatively strong against an external force, so that peeling etc., of the nozzle member from the substrate can be avoided. Further, the adhesive strength at this region between the discharge port surface and the protective tape is strong, so that even should ink somehow seep out of a discharge port, the problem of the ink mixing with other colors, and this mixed color ink being sucked back into the original discharge port to cause color mixing as far as inside the ink channel, can be prevented. For example, the distance between a groove provided at the position furthest away from a discharge port for a certain ink color and a groove provided at the position furthest away from a discharge port for another given color adjacent thereto is set maximal. Even should ink leak from the discharge port of the certain color, because the inter-groove distance between adjacent grooves provided for adjacent discharge ports of different colors is larger than the inter-groove distance between adjacent grooves provided for adjacent discharge ports of the same color, the inks of the respective colors can be prevented from mixing.

Thus, by increasing the inter-groove distance between adjacent grooves provided for adjacent discharge ports of different colors, the contact surface area of the protective tape between different colors can be secured.

Third Exemplary Embodiment

In the present embodiment, as illustrated in FIGS. 4A to 4F, in a mode having discharge ports 506 and 506' which discharge ink droplets in a plurality of sizes, fine grooves 500 are provided in concentric circles centered around each discharge port. An inkjet recording head was produced having different discharge port diameters and groove shapes based on the size of the discharged ink droplets, and the effects thereof were confirmed. The configuration is such that the diameter of discharge ports 506' is smaller than the diameter of discharge ports 506, and these two types of discharge port are provided on the same substrate. The difference with the first and second embodiments is in the method for producing the discharge port shapes and the nozzle grooves. In the present embodiment, the discharge ports 506 and 506' and the grooves 500 are formed by laser processing with laser irradiation. As the laser, an excimer laser capable of oscillating UV light is desirable. Excimer lasers have the advantages of being high intensity, having good monochromaticity, having directivity, being capable of oscillating in short pulses, and being capable of a very large energy density by focusing light with a lens. Further, the oscillator of an excimer laser can oscillate UV light in short pulses (15 to 35 ns) by discharge excitation of a mixed gas of a rare gas and halogen. Kr—F, Xe—Cl, and Ar—F lasers are often employed. The oscillation energy of these lasers is several 100 mJ/pulse, and the pulse repetition frequency is 30 to 100 Hz. If high-intensity short pulses of UV light from such an excimer laser beam are irradiated on a resin surface, the irradiated portions instantaneously decompose and scatter about along with plasma emission and a percussive sound. An ablative photodecomposition (APD) process occurs, and the resin can be processed by this process.

Figure 5A:
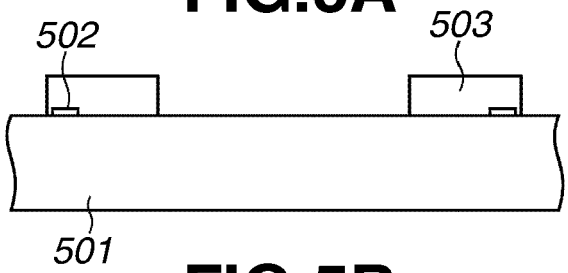
FIGS. 5A to 5E are schematic diagrams illustrating the production steps of a discharge port portion of the inkjet recording head according to the third embodiment.
Figure 5B:
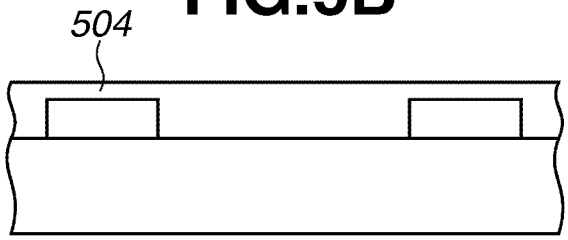
Figure 5C:
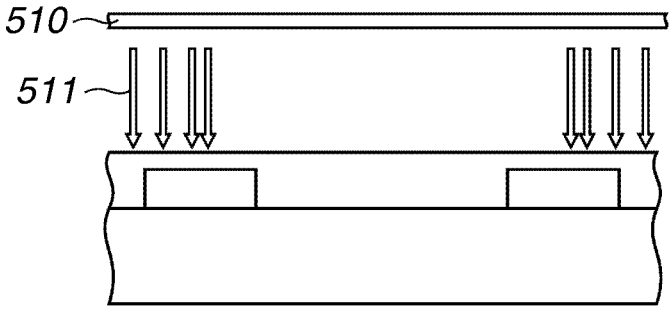
Figure 5D:
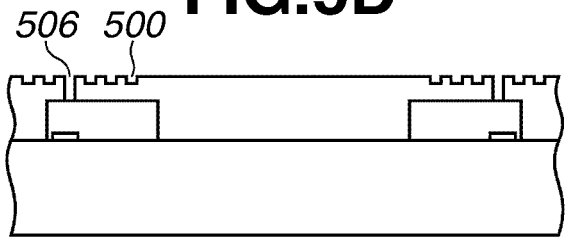
Figure 5E:
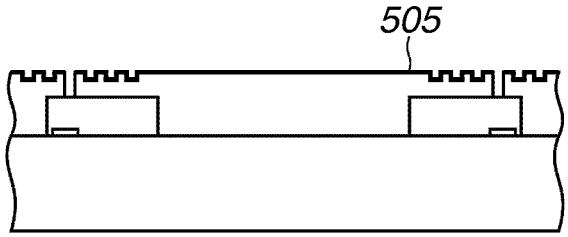

FIGS. 5A to 5E are cross-sectional schematic views illustrating an example of the basic production steps of a nozzle member in the inkjet recording head according to the present embodiment. A plurality of electrothermal transducers 502 are provided on the Si substrate 501 illustrated in FIG. 5A. A soluble resin mold material 503, which will become an ink channel, is formed on the Si substrate 501. The mold material (ODUR, manufactured by Tokyo Ohka Kogyo Co., Ltd.) is applied by spin coating, and then the applied coating is exposed and developed to form a pattern. Next, as illustrated in FIG. 5B, a nozzle forming member 504 is applied by spin coating, and then cured by heating. The nozzle forming member 504 is produced by dissolving an epoxy resin and a photocationic polymerization initiator in a solvent. Then, as illustrated in FIG. 5C, a mask 510 having laser transmission portions and non-transmission portions corresponding to the discharge ports and the shape of the grooves is arranged between the nozzle forming member 504 and the excimer laser oscillator. As illustrated in FIG. 5D, the discharge ports 506 and 506' or the grooves 500 are formed by irradiating excimer laser light 511 to break up and remove the resin of the irradiated portions. By changing the laser transmittance at this stage at the discharge ports and the groove portion, specifically, by using a gradated mask on the portion corresponding to the groove portion, the groove portion is irradiated with lower intensity excimer laser light than the discharge portions. As a result, discharge ports and grooves having different depths from the surface of the nozzle forming member 504 can be formed. Next, as illustrated in FIG. 5E, a water-repellent member 505 is applied by spin coating on the nozzle forming member 504 on which the discharge ports 506 or 506' and grooves 500 are formed. A mirror projection mask aligner (MPA-600 Super, manufactured by Canon Inc.) is used. A water-repellent treatment is performed on the whole region of the discharge port surface, including the interior of the grooves 500, by exposing the water-repellent member 505 via a mask, and then removing the regions which were not exposed with a developing solution.

Figure 4A:
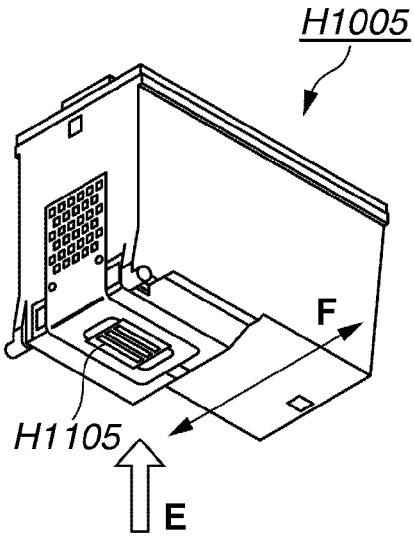
FIGS. 4A to 4F are schematic diagrams illustrating the configuration of an inkjet recording head and a discharge port periphery according to a third embodiment of the present invention.
Figure 4B:
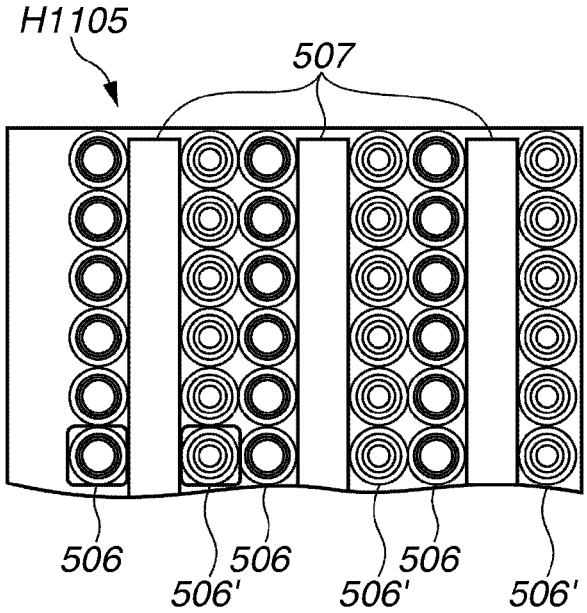
Figure 4C:
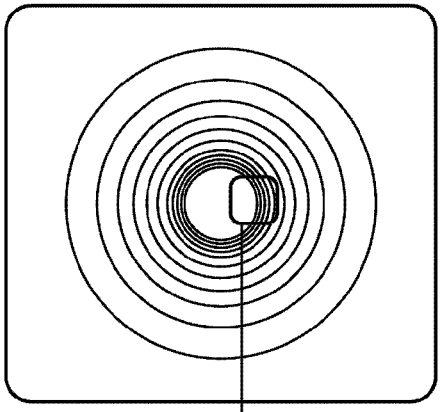
Figure 4E:
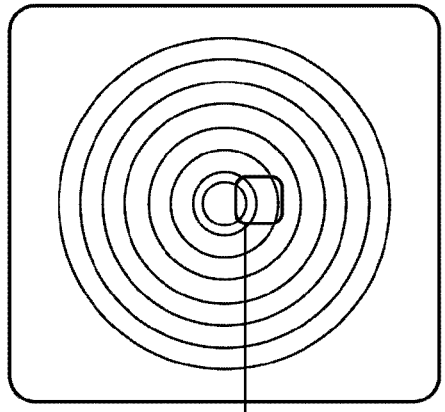
Figure 4D:
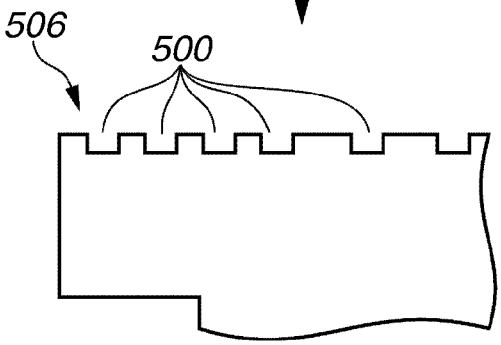
Figure 4F:
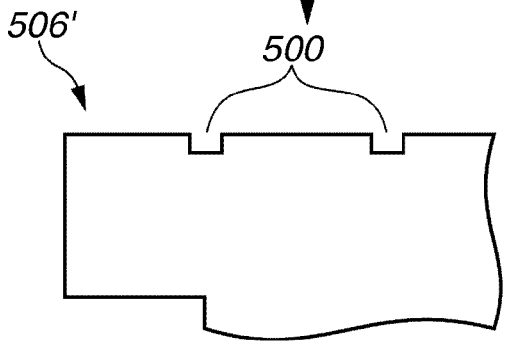

Further, the nozzle members of the inkjet recording head are formed by undergoing similar steps as in FIGS. 2A to 2H of the first embodiment, and then the nozzle members are separated by cutting with a dicing saw to form into chips. Using a recording element substrate H1105 which has been formed into a chip, an inkjet recording head H1005 illustrated in FIG. 4A is produced according to the above-described steps. FIG. 4B is an enlarged view of a discharge port surface when the recording head illustrated in FIG. 4A is seen from the direction of arrow E. FIG. 4C is an enlarged view of the discharge port 506. FIG. 4E is an enlarged view of a small-diameter discharge port 506' portion provided in the inkjet recording head H1005. FIG. 4F is an enlarged cross-sectional view of grooves 500 provided on a peripheral region of the discharge port 506'. It is noted that FIGS. 4B, 4C, and 4E are views when the recording head illustrated in 4A is seen from the discharge port surface side, which is the direction of arrow E, and FIGS. 4D and 4F are cross-sectional views in the direction of arrow F, which is orthogonal to arrow E.

Three ink supply ports 507 are formed on the recording element substrate H1105. Large-diameter discharge ports 506 and small-diameter discharge ports 506' are arranged in opposing positions centered around each of the ink supply ports 507. The dimensions of the discharge ports and the ink channels are adjusted so that ink droplets of about 5 pL are discharged from one side across an ink supply port and ink droplets of about 2 pL are discharged from the opposite side. On the peripheral portions of the discharge ports 506 from which ink droplets of about 5 pL are discharged, grooves 500 having a depth of about 2 μm and a width of about 2 μm are formed in concentric circles centered around the discharge port at a pitch (inter-groove distance) of about 4 μm. The pitch gradually increases moving further away from the discharge ports, so that on the peripheral portions of the discharge ports 506' from which ink droplets of about 2 pL are discharged, grooves 500 having a depth of about 2 μm and a width of about 2 μm are formed in concentric circles centered around the discharge port at a pitch (inter-groove distance) of about 12 μm. A protective tape is stuck on such an inkjet recording head H1005. Using the above-described protective tape, the tape is stuck so as to completely cover the discharge ports 506 and 506'. An inkjet recording head H1005 in this state was subjected to an accelerated test in which the inkjet recording head was stored for two months in an environment maintained at 60° C. Then, the protective tape was peeled off, and printing was performed. As in the first and second embodiments, no peeling of the nozzle member from the substrate or cracks etc., on the discharge port peripheral portions occurred, and the printing was also good. Thus, the grooves provided on the discharge port peripheral portions were very effective.

Here, the nozzle diameter, nozzle array pitch, the hollow structure of the channels, and the strength against an external force will be described using FIGS. 6A to 6F.

Figure 6A:
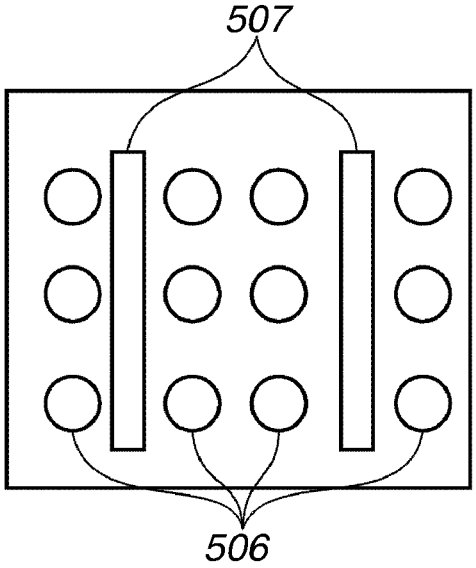
FIGS. 6A to 6F are schematic diagrams illustrating types of discharge port surfaces and ink channels.
Figure 6D:
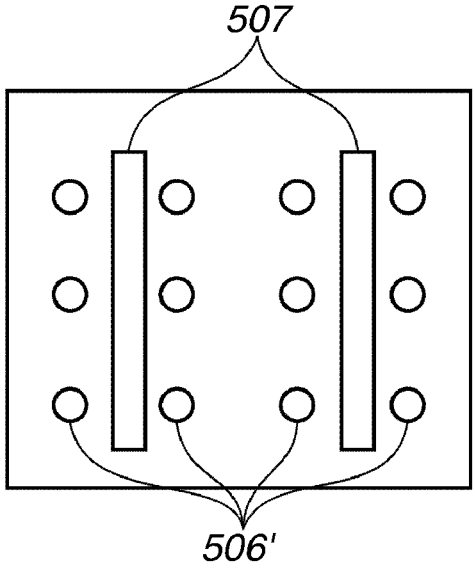
Figure 6B:
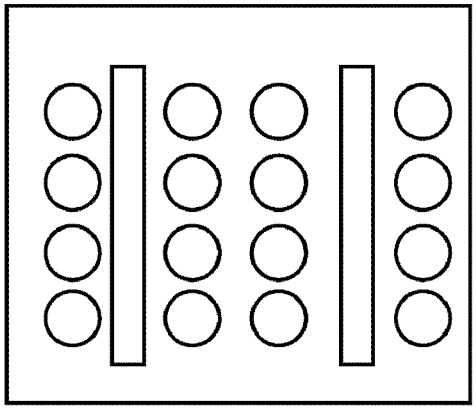
Figure 6E:
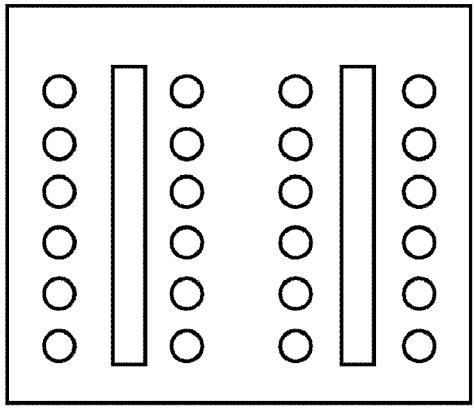
Figure 6C:
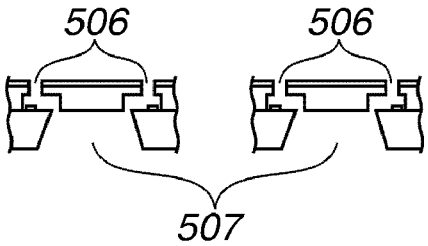

FIGS. 6A to 6F are schematic diagrams, as seen from the discharge port surface, of discharge ports 506 which discharge 5 pL ink droplets (hereinafter referred to as "large diameter"), discharge ports 506' which discharge 2 pL ink droplets (hereinafter referred to as "small diameter"), and ink supply ports 507. In FIG. 6A, large-diameter discharge ports are provided at a given array pitch. Here, the "array pitch" of the discharge ports means the distance between the centers of the discharge ports. In contrast, in FIG. 6B, the same large-diameter discharge ports are provided at a narrower array pitch. FIG. 6C is a cross-sectional schematic diagram illustrating the structure of large-diameter discharge port channels which intersect the discharge port surface. As can be seen from FIGS. 6A and 6B, when the discharge port diameters are the same, the discharge ports of FIG. 6A, which have a larger array pitch, can secure a contact surface area with the protective tape. The same also applies for FIGS. 6D and 6E, in which small-diameter discharge ports are provided. Thus, the discharge ports of FIG. 6D, which has a larger array pitch, can secure a better contact surface area with the protective tape.

Next, FIGS. 6A and 6D will be compared. Although the discharge port diameters in these two figures are different, the array pitch of the discharge ports is the same. In this case, when the array pitch of the discharge ports is the same, the smaller discharge port diameters of FIG. 6D can secure a better contact surface area with the protective tape.

Figure 6F:
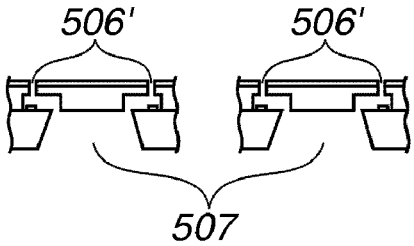

Further, looking at the channel cross-sectional views in FIGS. 6C and 6F, for the large-diameter discharge ports illustrated in FIG. 6C, it can be seen that the hollow structure of the channel cross-section is itself large. In contrast, for the small-diameter discharge ports illustrated in FIG. 6F, since the diameter is smaller, the hollow structure of the channel cross-section is itself smaller than in FIG. 6C. If the array pitch of the discharge ports is the same, the hollow structure has more space in the large-diameter discharge ports than in the small-diameter discharge ports, and is thus weaker to an external force. However, in fact, as illustrated in FIG. 6E for a case of small-diameter discharge ports, a high-density array pitch can be provided. Therefore, since the number of channels is increased, the space as a hollow structure increases, so that the discharge ports are weaker to an external force. Even if a contact surface area with the protective tape is secured, the greater the space of the hollow structures, the weaker the discharge ports are to an external force. In the third embodiment, grooves are provided on the discharge port peripheral portions, and the shape of the grooves is changed according to differences in the discharge amount. In the present embodiment, the array pitch of the large and small discharge ports is the same. Therefore, the hollow structures are such that the large-diameter discharge ports have a larger proportion of space, and the small-diameter discharge ports have a smaller proportion of space. More specifically, as illustrated in FIGS. 4E and 4F, on the peripheral portions of the discharge ports 506' which discharge ink droplets of about 2 pL and which have a relatively high strength against an external force, the contact surface area with the protective tape is secured by providing the grooves at a relatively wide inter-groove distance. In contrast, as illustrated in FIGS. 4C and 4D, on the peripheral portions of the discharge ports 506 which discharge ink droplets of about 5 pL and which have a relatively low strength against an external force, the grooves are provided at a relatively narrow pitch. Thus, the contact surface area between the discharge port surface and the protective tape adhesive material is changed by changing the shape of the grooves according to the difference in strength against an external force. As a result, color mixing caused by cracks on the discharge port periphery and ink seepage can be prevented from occurring. Therefore, an inkjet recording head which can be distributed in a state in which the discharge ports are protected and sealed by a protective tape can be easily provided. One example of a method for securing the contact surface area with the protective tape is to change the groove shape itself. If the groove width over the whole surface area of a pre-defined discharge port surface is widened, the contact surface area with the protective tape at the discharge port surface decreases, while if the groove width is narrowed, the contact surface area with the protective tape at the discharge port surface increases. On the other hand, the contact surface area can also be adjusted by changing the inter-groove distance. If the inter-groove distance is narrowed, the contact surface area with the protective tape decreases, while if the inter-groove distance is widened, the contact surface area can be increased.

The present invention is not limited to the above-described embodiments or other specific shapes. The groove shape and the inter-groove distance can be adjusted as necessary. By making the groove shape and inter-groove distance of the discharge port peripheral region different from other regions further away, the contact surface area between the protective tape and the discharge port surface can be made to differ. Specifically, the discharge port peripheral region can have a smaller contact surface area, and other regions away from the discharge ports can have a larger contact surface area. As a result of such a configuration, color mixing caused by cracks on discharge port peripheral portions due to peeling off of the protective tape, and ink seepage from a discharge port, can be prevented.

FIGS. 7A and 7B to FIG. 9 are diagrams for illustrating an inkjet recording head according to an exemplary embodiment of the present invention. Further, FIG. 10 is a diagram illustrating the configuration of an inkjet recording apparatus which uses an inkjet recording head mounted thereon.

The respective structural elements will now be described with reference to these figures.

Figure 7A:
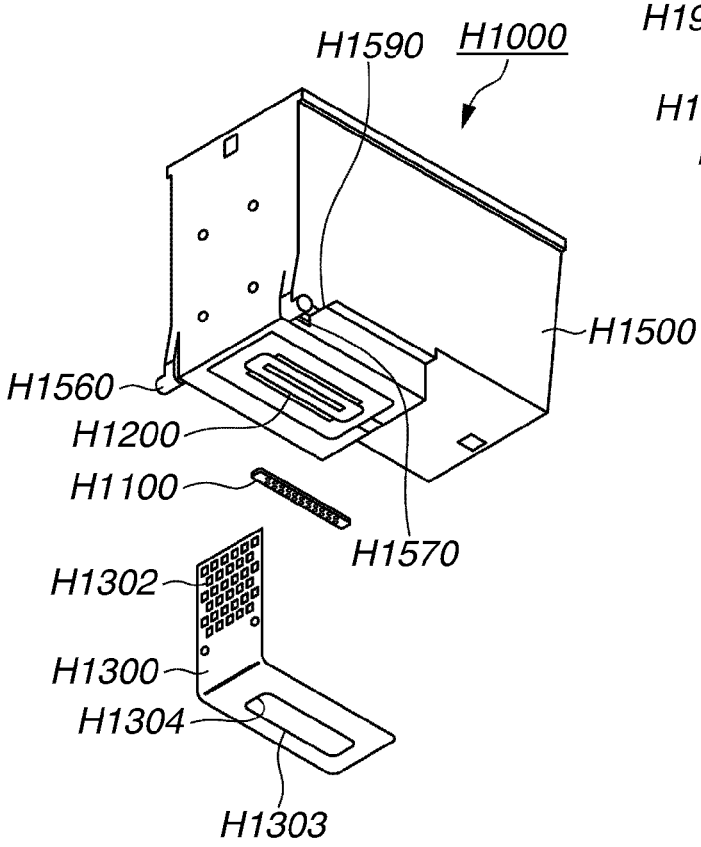
FIGS. 7A and 7B are schematic exploded perspective views illustrating an inkjet recording head.
Figure 7B:
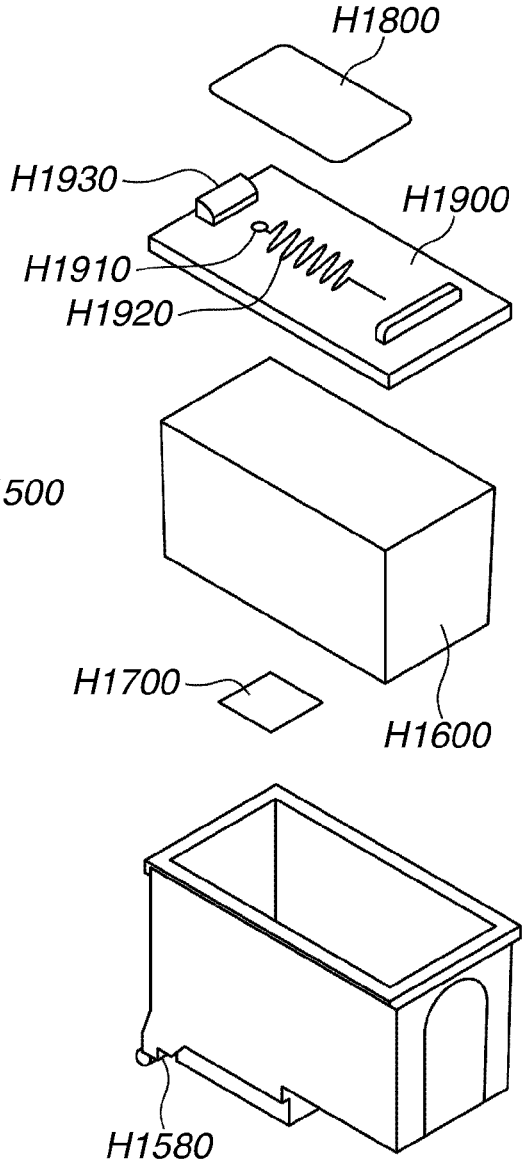

As illustrated in FIGS. 7A and 7B, the inkjet recording head according to the present embodiment forms an integrated structure with an ink tank. The inkjet recording head H1000 in FIG. 7A is supported and fixed by a positioning unit and an electrical contact of a carriage mounted in an inkjet recording apparatus body, and is detachable from the carriage. The ink tank can be replaced together with the head when the ink is completely consumed.

Next, each of the structural elements constituting the inkjet recording head will be described in order below.

(1) Inkjet Recording Head

The inkjet recording head H1000 is a recording head of a type which uses film boiling, in which an electrothermal transducer and the discharge ports from which the ink droplets are discharged are provided opposite to each other. As illustrated in FIGS. 7A and 7B, the inkjet recording head H1000 includes a recording element substrate H1100, an electrical wiring tape H1300, an ink tank member H1500, a filter H1700, an ink absorber H1600, a cap member H1900, and a cap sealing member H1800.

(1-1) Recording Element Substrate

Figure 8:
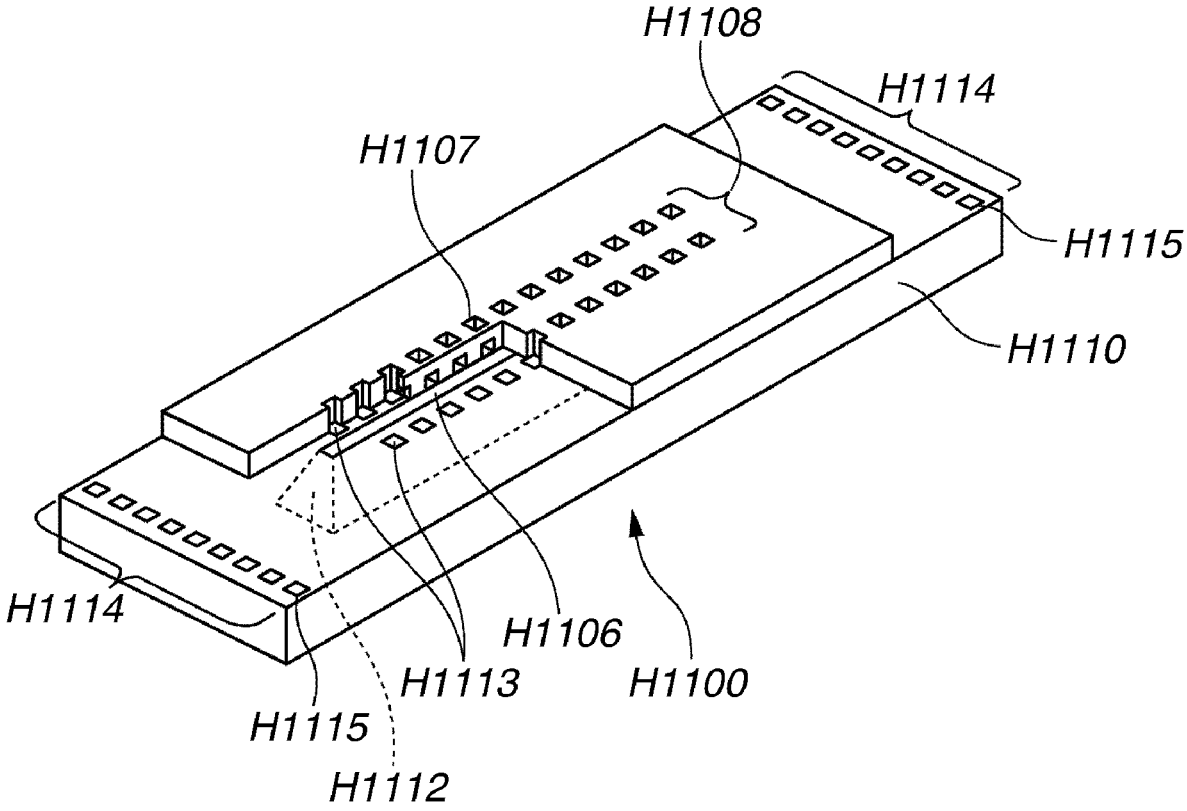
FIG. 8 is a cutaway schematic perspective view illustrating a part of a recording element substrate.

FIG. 8 is a partial cutaway perspective view illustrating the configuration of the recording element substrate H1100. The recording element substrate H1100, for example, is formed by a method in which a long groove-shaped through-hole ink supply port H1112, which is an ink channel, on a 0.5 to 1 mm-thick Si substrate H1110 is subjected to anisotropic etching utilizing the crystal orientation or to sandblasting.

An electrothermal transducer H1113 is provided on either side across the ink supply port 1112. Further, a not-illustrated electric wire made from aluminum or the like is formed for supplying power to the electrothermal transducers H1113. These electrothermal transducers H1113 and the electric wire are formed by a film-deposition technique. Electrode members H1114 for supplying power to the electric wire and supplying electric signals to drive the electrothermal transducers H1113 are formed aligned along the side edges of both outer sides of the electrothermal transducers H1113. Bumps H1115 made from silver or the like are formed on the electrode members H1114.

Further, a nozzle member is formed on the Si substrate H1110 having an ink channel wall H1106, which forms an ink channel corresponding to the electrothermal transducers H1113, and a ceiling member which covers thereabove. The nozzle member is formed so that the discharge ports H1107 are open to the ceiling member. The discharge ports H1107 are provided opposite to the electrothermal transducers H1113. The discharge ports H1107 form a discharge port group H1108. In the recording element substrate H1100, ink supplied from the ink supply port H1112 is discharged from the discharge ports H1107 opposite each of the electrothermal transducers H1113 by pressure from air bubbles generated by the heat from each of the electrothermal transducers H1113.

(1-2) Electrical Wiring Tape

Figure 9:
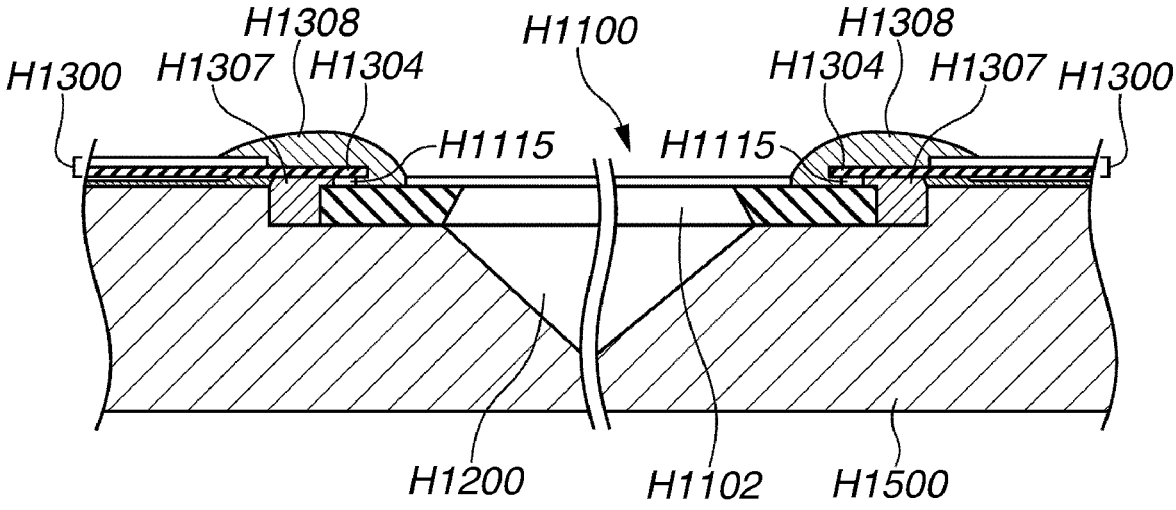
FIG. 9 is a schematic cross-sectional view illustrating a part of an inkjet recording head.
Figure 10:
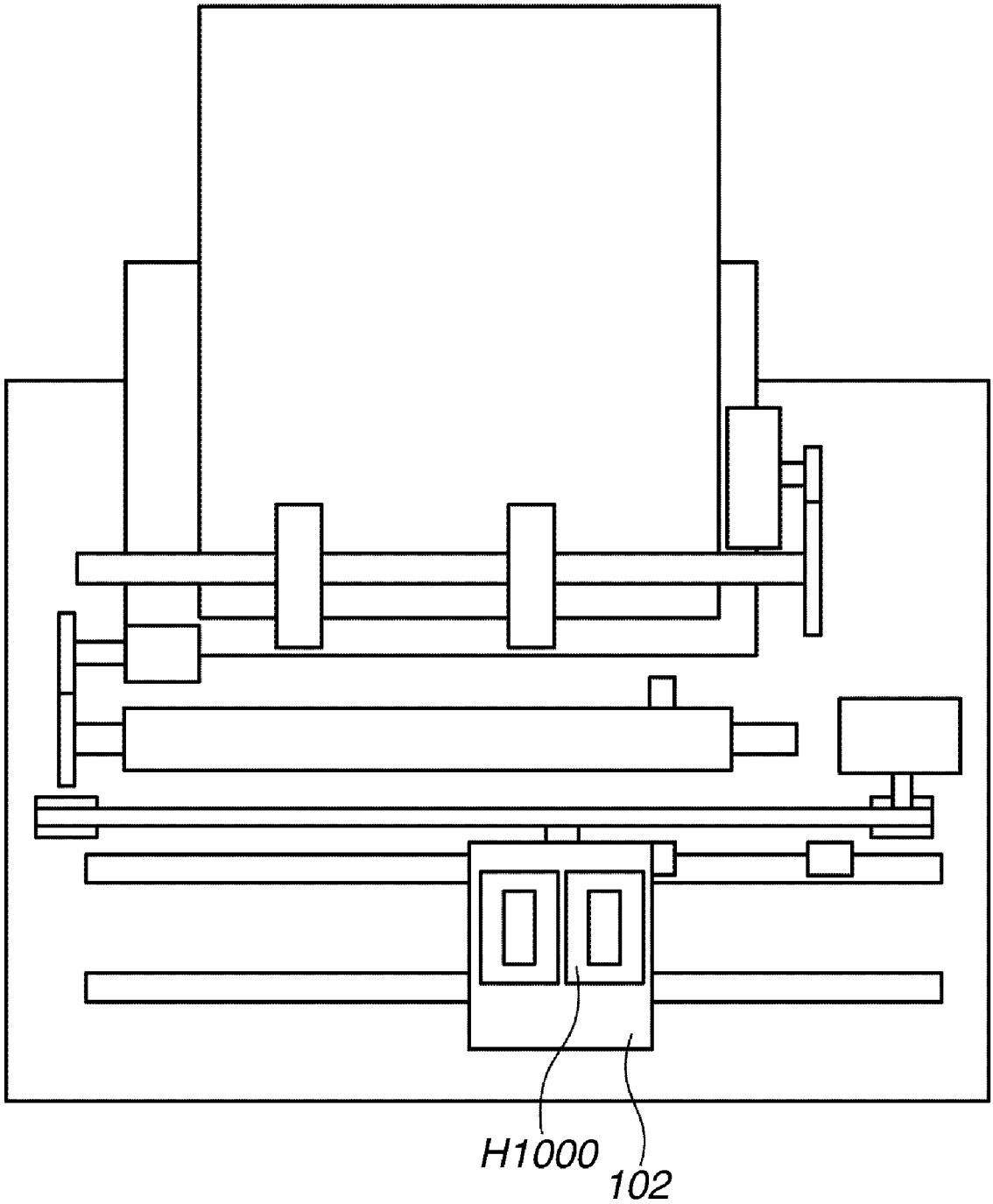
FIG. 10 is a schematic diagram illustrating a configuration example of an inkjet recording head.

As illustrated in FIGS. 7A, 7B, and 9, the electrical wiring tape H1300 forms an electric signal pathway which applies an electric signal for discharging ink to the recording element substrate H1100. An aperture member H1303 for incorporating the recording element substrate H1100 is formed, and an electrode terminal H1304 connected to the electrode members H1114 of the recording element substrate H1100 is formed near the edge of the aperture member H1303. Further, an external signal input terminal H1302 for receiving electric signals from a main apparatus is formed on the electrical wiring tape H1300. The electrode terminal H1304 and the external signal input terminal H1302 are connected by a continuous copper foil wiring pattern.

The electrical connection between the electrical wiring tape H1300 and the recording element substrate H1100 can have the following configuration, for example. The bumps H1115 formed on the electrode members H1114 of the recording element substrate H1100 and the electrode terminal H1304 of the electrical wiring tape H1300 corresponding to the electrode members H1114 of the recording element substrate H1100 can be electrically connected by a thermal ultrasonic pressure bonding method.

(1-3) Ink Tank Member

The ink tank member H1500 is formed, for example, by resin molding. It is desirable to use a resin material which is mixed with 5 to 40% of a glass filler to improve shape rigidity. As illustrated in FIG. 7B, the ink tank member H1500 has an ink absorber H1600 for retaining the ink in its interior and producing a negative pressure. The ink tank member H1500 has a function of ink storage, and a function of ink supply by forming an ink channel for leading that ink to the recording element substrate H1100. While compressed polypropylene fiber (PP fiber) is used for the ink absorber H1600, compressed urethane fiber can also be used. On a boundary portion with the ink absorber H1600, which is an upstream portion of the ink channel, a filter H1700 is joined by welding to prevent dust etc., from entering inside the recording element substrate H1100. While the filter H1700 can be a SUS metal mesh type, desirably it is a SUS metal fiber sintered type.

As illustrated in FIG. 9, an ink supply port H1200 for supplying ink to the recording element substrate H1100 is formed on a lower portion of the ink channel. The recording element substrate H1100 is adhesively fixed with good positional accuracy to the ink tank member H1500 so that the ink supply port H1112 of the recording element substrate H1100 is in communication with the ink supply port H1200 of the ink tank member H1500. A first adhesive used in this adhesion desirably has a low degree of viscosity, cures in a short time, after curing has a relatively high degree of hardness, and has ink resistance. Examples of the first adhesive include thermosetting adhesives having an epoxy resin as a main component. The thickness of the adhesive layer at such a stage is desirably about 50 μm.

Further, a part of the rear surface of the electrical wiring tape H1300 is adhesively fixed by a second adhesive to the flat surface of the adhesion surface periphery of the recording element substrate H1100. The electrical connection portion between the recording element substrate H1100 and the electrical wiring tape H1300 is sealed by a first sealant H1307 and a second sealant H1308 (refer to FIG. 9), so that the electrical connection portion is protected from corrosion by the ink and from external shocks. The first sealant H1307 mainly seals the rear surface side of the connection portion between the electrode terminal H1304 of the electrical wiring tape H1300 and the bumps H1115 of the recording element substrate H1100 and the outer peripheral portion of the recording element substrate H1100. The second adhesive H1308 seals the front side of the above-described connection portion. Further, non-connection portions of the electrical wiring tape are bent, and are fixed by thermal caulking, adhesion or the like to a side surface which is roughly perpendicular to the adhesion surface of the ink tank member H1500 for the recording element substrate H1100.

(1-4) Cap Member

As illustrated in FIG. 7B, the cap member H1900 forms the ink tank member H1500 as an enclosed space by being welded to an upper aperture portion of the ink tank member H1500. However, the cap member H1900 has a fine aperture H1910 to equalize pressure variations inside the ink tank member H1500, and a fine groove H1920 which is in communication therewith. Most of the fine aperture H1910 and the fine groove H1920 are covered by a sealing member H1800. An atmosphere communication aperture is formed by opening an edge portion of the fine groove H1920. Further, the cap member H1900 has an engaging member for fixing the inkjet recording head H1000 to the inkjet recording apparatus.

(1-5) Mounting of the Inkjet Recording Head on the Inkjet Recording Apparatus

As illustrated in FIG. 7A, the inkjet recording head has a mounting guide H1560 for guiding to the carriage mounting position of the inkjet recording apparatus body. Further, the inkjet recording head H1000 has an engaging member H1930 for mounting and fixing to the carriage by a head set lever. In addition, the inkjet recording head H1000 has abutting portions for positioning in a certain mounting position of the carriage. Specifically, these include a abutting portion H1570 for the X direction (carriage scan direction), a abutting portion H1580 for the Y direction (recording object conveyance direction), and a abutting portion H1590 for the Z direction (ink discharge direction). By positioning with these abutting portions, the external signal input terminal H1302 on the electrical wiring tape H1300 is correctly electrically connected with the contact pins of the electrical connection portion provided in the carriage.

(2) Inkjet Recording Apparatus

Next, an inkjet recording apparatus capable of mounting such a cartridge type inkjet recording head will be described. FIG. 10 is a diagram illustrating an example of an inkjet recording apparatus capable of mounting the inkjet recording head according to the present embodiment.

In the recording apparatus illustrated in FIG. 10, the inkjet recording head H1000 illustrated in FIG. 7 is positioned on a carriage 102 and mounted so that it can be replaced. An electrical connection portion for transmitting a drive signal and the like to each of the discharge ports via the external signal input terminal on the inkjet recording head H1000 is provided on the carriage 102.

The inkjet recording head H1000 is mounted on the carriage 102 so that the arrayed direction of the discharge ports is orthogonal to the scanning direction of the carriage 102. The inkjet recording head H1000 performs recording by discharging ink from these discharge ports.

It is noted that the recording apparatus capable of mounting the inkjet recording head according to an exemplary embodiment of the present invention includes, in addition to a common inkjet recording apparatus, apparatuses such as copying machines, facsimiles having a communication system, word processors having a print unit and the like. Further, a multi-function inkjet recording apparatus that combines these apparatuses is also included.

COMPARATIVE EXAMPLE

Figure 11A:
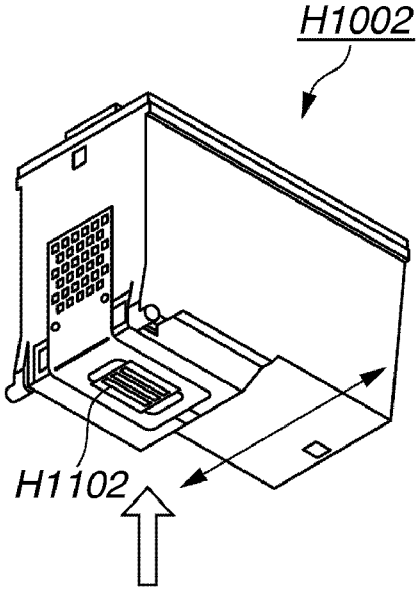
FIG.11A PRIOR ART
FIGS. 11A and 11B are schematic diagrams illustrating the configuration of a conventional inkjet recording head and discharge port periphery.
Figure 11B:
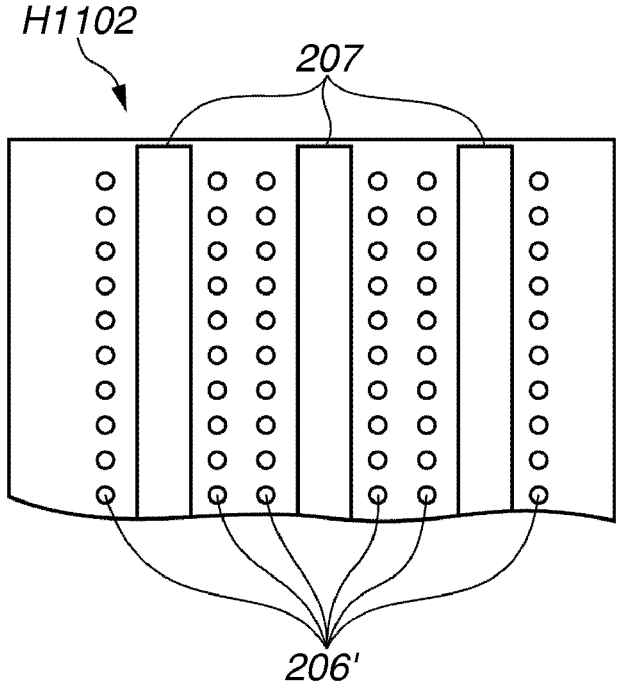
FIG.11B PRIOR ART
Figure 12:
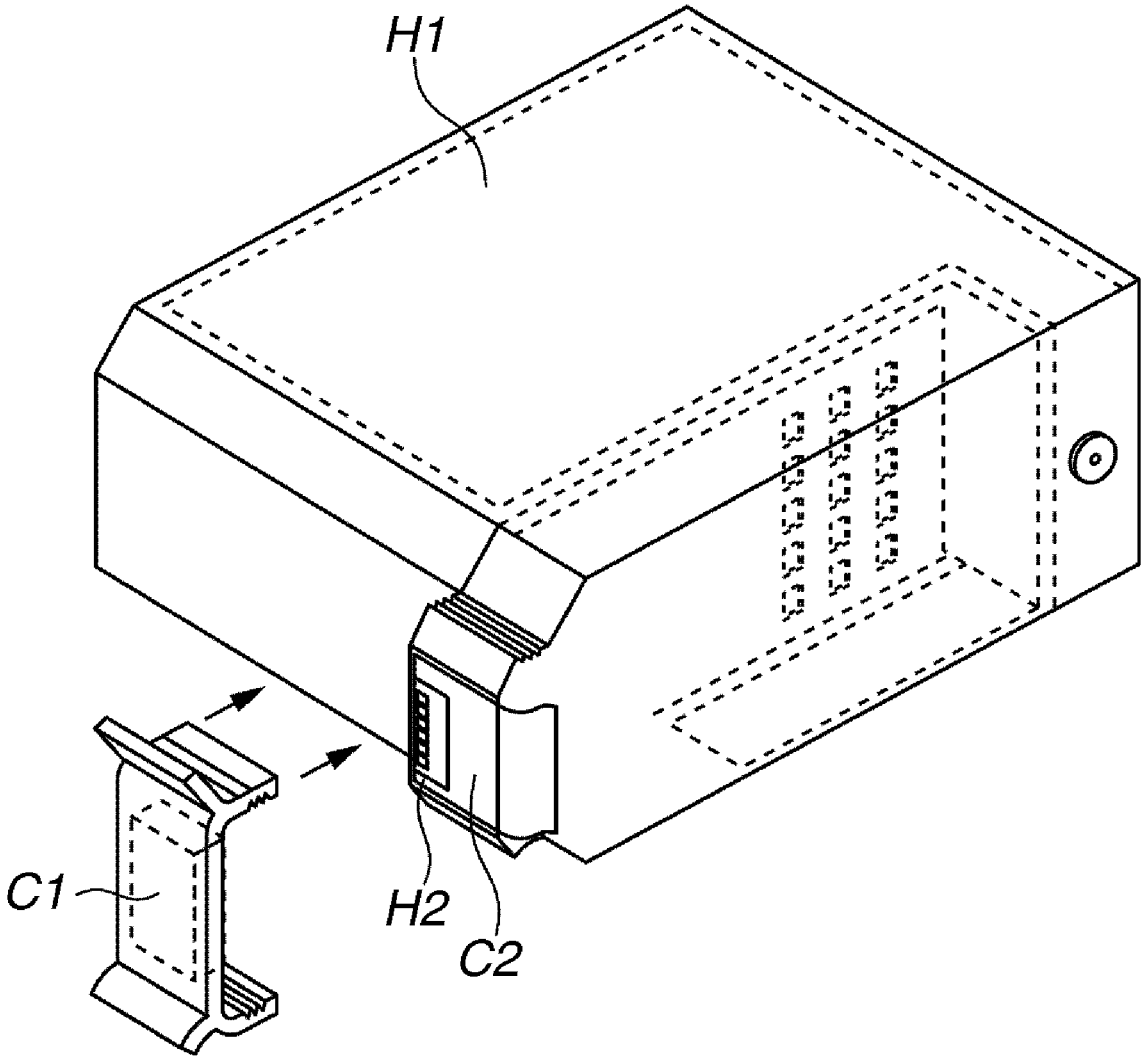
FIG.12 PRIOR ART
FIG. 12 is a perspective view illustrating an example of a protective seal mode on a conventional inkjet recording head.
Figure 13A:
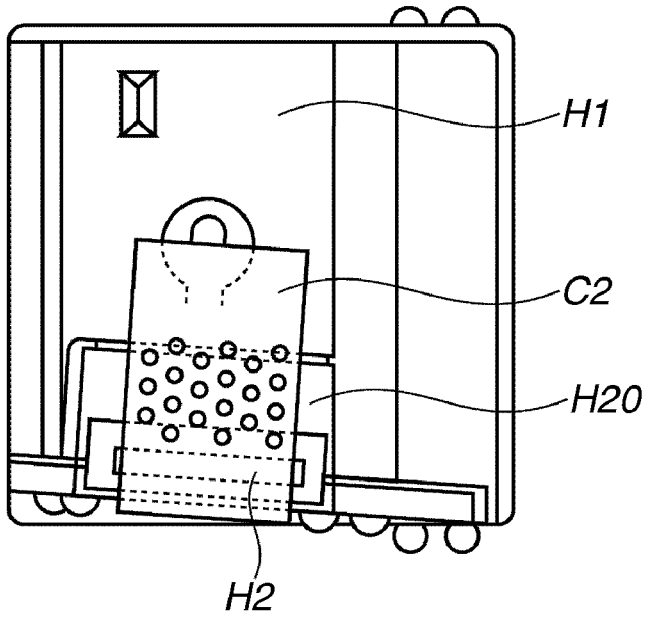
FIG.13A PRIOR ART
FIGS. 13A and 13B are perspective views illustrating another example of a protective seal mode on a conventional inkjet recording head.
Figure 13B:
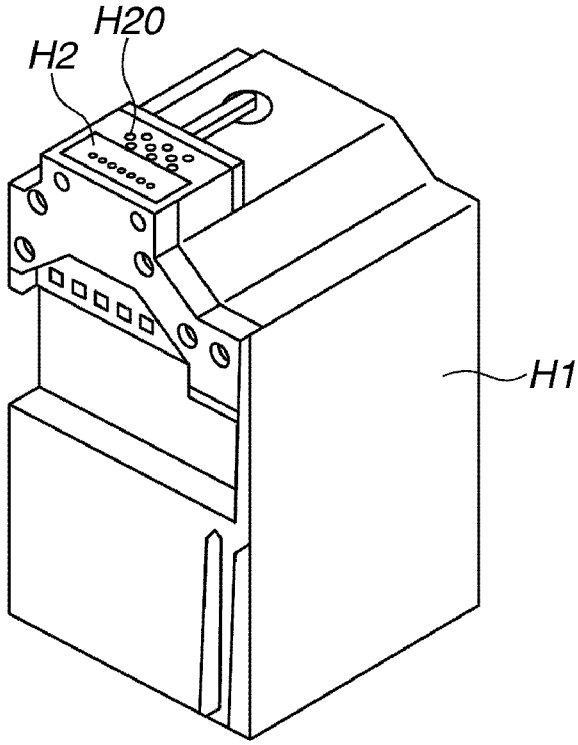
FIG.13B PRIOR ART
Figure 14:
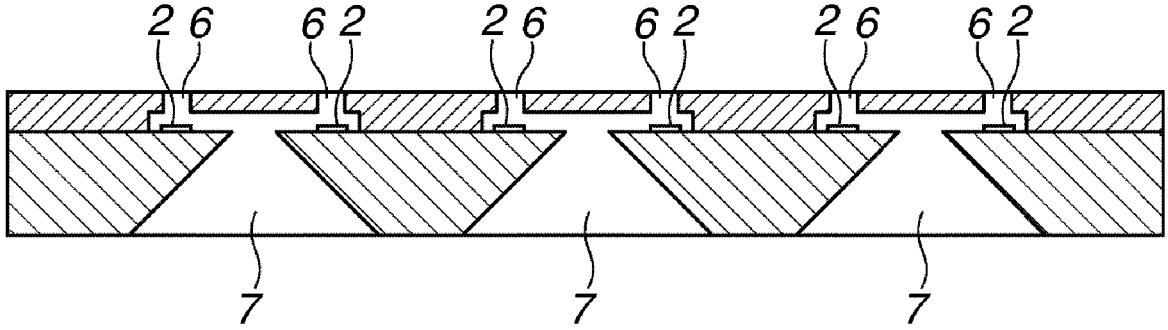
FIG.14 PRIOR ART
FIG. 14 is a schematic diagram illustrating a configuration example of a conventional inkjet recording head nozzle member.
Figure 15A:
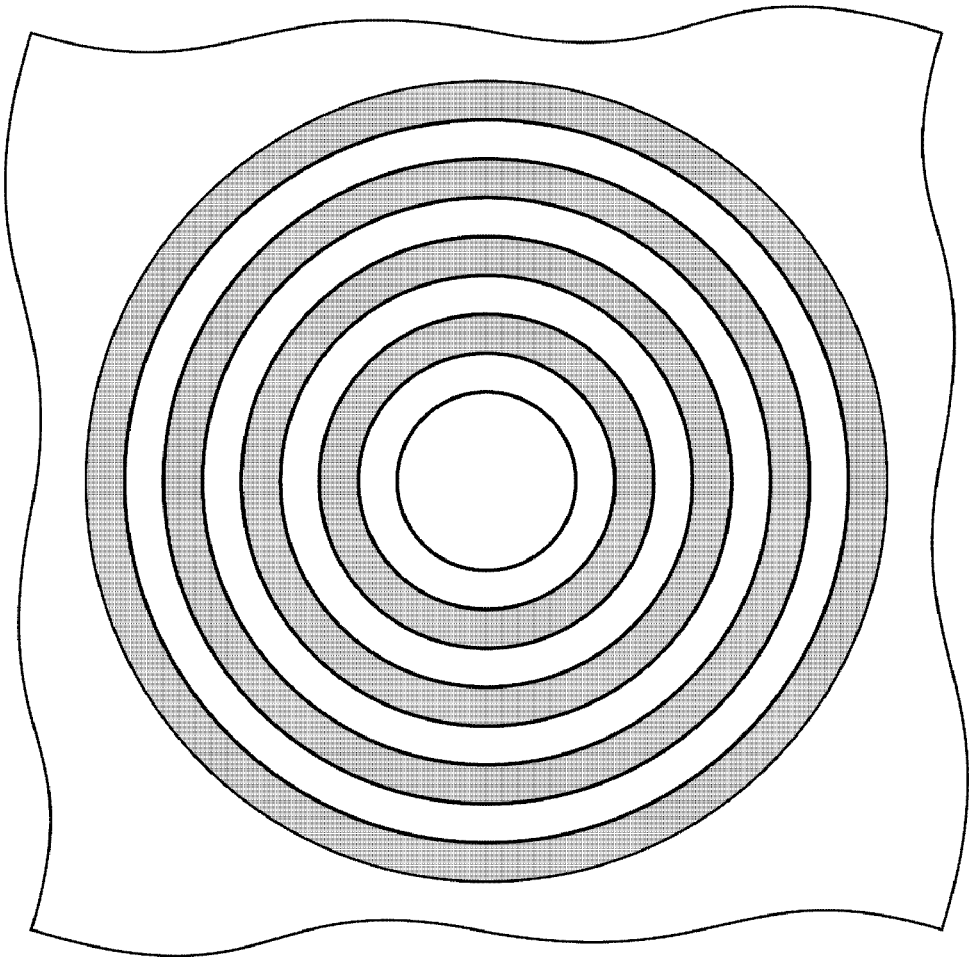
FIG.15A PRIOR ART
FIGS. 15A and 15B are schematic diagrams illustrating another configuration example of a conventional inkjet recording head nozzle member.
Figure 15B:
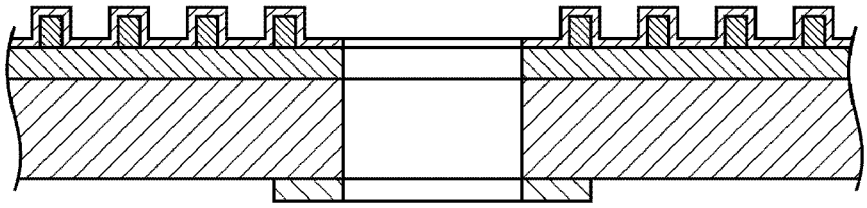
FIG.15B PRIOR ART

As illustrated in FIGS. 11A and 11B, equal-diameter discharge ports 206' were formed on a recording element substrate H1102, which was then turned into a chip. An inkjet recording head H1002 was then produced using the recording element substrate H1102. The discharge ports 206' discharge 2 pL ink droplets. Three ink supply ports 207 are formed on the recording element substrate H1102. Each of the inks are retained in a supply retaining member so that one of cyan, magenta, or yellow ink is supplied from each of the ink supply ports 207. Discharge ports 206' are formed in opposing positions centered around each of the ink supply ports. The dimensions of the discharge ports and the ink channels are adjusted so that ink droplets of about 2 pL are discharged from each of the discharge ports 206'. A protective tape is stuck on such an inkjet recording head H1002. Using the same protective tape as in the embodiments, the tape is stuck so as to completely cover the discharge ports 206'. The inkjet recording head H1002 in this state was subjected to an accelerated test in which the inkjet recording head 206' was stored for two months in an environment maintained at 60° C. Then, the protective tape was peeled off, and printing was performed. When the discharge port surface was observed using a metal microscope after the protective tape has been peeled off, cracks were found on the discharge port peripheral portions. The inkjet recording head H1002 had an array pitch among the discharge ports arranged at a narrow pitch. Since the proportion of the nozzle members occupied by the ink channel, or in other words, the proportion of the hollow structure, was increased, the strength against an external force was presumed to decrease.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2007-264536 filed Oct. 10, 2007 and No. filed Aug. 4, 2008, which are hereby incorporated by reference herein in their entirety.

What is claimed is:

1. A recording head comprising:

a first discharge port configured to discharge a predetermined amount of ink;

a second discharge port, a diameter of the second discharge port being larger than a diameter of the first discharge port;

a discharge port surface on which the first discharge port and the second discharge port are formed;

a plurality of first grooves formed around the first discharge port on the discharge port surface; and a plurality of second grooves formed around the second discharge port on the discharge port surface, wherein a distance between the second grooves is smaller than a distance between the first grooves.

2. The recording head according to claim 1, wherein the plurality of point-symmetrical continuous grooves are provided in a circle or at an angle centered around each discharge port.

3. The recording head according to claim 1, wherein the discharge port surface and the plurality of point-symmetrical continuous grooves are subjected to a water-repellent treatment.

4. The recording head according to claim 1, wherein the discharge port surface is protected by a tape via an adhesive.

* * * * *